US009433071B2

(12) United States Patent
Zaidi

(10) Patent No.: US 9,433,071 B2
(45) Date of Patent: Aug. 30, 2016

(54) DIELECTRIC BARRIER DISCHARGE PLASMA GENERATOR

(71) Applicant: Plasma Innovations, LLC, Paddington, NJ (US)

(72) Inventor: Sohail H. Zaidi, San Jose, CA (US)

( * ) Notice: Subject to any disclaimer, the term of this patent is extended or adjusted under 35 U.S.C. 154(b) by 266 days.

(21) Appl. No.: 14/304,569

(22) Filed: Jun. 13, 2014

(65) Prior Publication Data

US 2015/0366042 A1 Dec. 17, 2015

(51) Int. Cl.
*H05H 1/24* (2006.01)

(52) U.S. Cl.
CPC ..... *H05H 1/2406* (2013.01); *H05H 2001/245* (2013.01); *H05H 2001/2462* (2013.01)

(58) Field of Classification Search
CPC ..... H05H 1/2406; H05H 2001/2462
See application file for complete search history.

(56) References Cited

U.S. PATENT DOCUMENTS 5,653,811 A * 8/1997 Chan ..... H01J 37/20 118/723 I
5,907,221 A * 5/1999 Sato ..... H01J 37/321 118/723 MP
6,027,988 A * 2/2000 Cheung ..... H01L 21/2236 257/E21.143
6,051,073 A * 4/2000 Chu ..... H01J 37/321 118/723 E
6,228,176 B1 * 5/2001 Chu ..... C23C 14/48 118/723 R
6,259,209 B1 * 7/2001 Bhardwaj ..... H05H 1/46 118/723 AN
6,578,515 B2 * 6/2003 Sakamoto ..... C23C 16/24 118/715
9,295,535 B2 * 3/2016 Holbeche ..... A61C 17/0202
2011/0295140 A1 * 12/2011 Zaidi ..... A61B 5/0075 600/532

* cited by examiner

*Primary Examiner* — Douglas W Owens
*Assistant Examiner* — Srinivas Sathiraju
(74) *Attorney, Agent, or Firm* — Ryder, Lu, Mazzeo & Konieczny LLC; Joseph M. Konieczny, Sr.; Gregory J. Gore

(57) ABSTRACT

A dielectric barrier discharge plasma generation devices that controllably produces uniform, non-equilibrium plasma and discharges a plasma plume at atmospheric pressure. The device has a gas source, a power source, and a plasma generator probe from which the plume of plasma is discharged. The probe has an elongate, dielectric ionization conduit arranged in coaxial relationship within the housing. An elongate inner electrode extends within the ionization conduit and connects to the power source. An outer electrode is slidably arranged on the outer surface of the ionization conduit, and is also electrically connected to the power source. The electrodes are constructed and arranged so that movement of the outer electrode relative to the inner electrode changes at least one property of the plasma plume. The inner electrode may include means for generating a plurality of separate, high-intensity electric fields along the length and around the perimeter of the inner electrode distal portion. In a preferred embodiment, the inner electrode has an elongate base extending generally parallel to the central axis of the ionization tube, and a plurality of bristles electrically-connected to and transversely-extending from at least a portion of the electrode base.

33 Claims, 10 Drawing Sheets

DIELECTRIC BARRIER DISCHARGE PLASMA GENERATOR

FIELD OF THE INVENTION

The invention relates to dielectric barrier discharge (DBD) plasma generation devices. In particular, the invention relates to a DBD plasma generator that controllably produces uniform, non-equilibrium plasma and discharges a plasma plume at atmospheric pressure.

BACKGROUND OF THE INVENTION

Non-thermal, non-equilibrium DBD plasma plumes/jets are known in the prior art and have many medical and engineering applications including wound healing, wound sterilization, blood coagulation, scar treatment, surface decontamination, surface treatment, and plasma sterilization. The plume of non-equilibrium DBD plasma generators is discharged in open air and does not require any special plasma enclosure. Therefore, the plume can be located at any distance from the application target without interference with the generator structure. Furthermore, the risk of contamination from contact with or adherence between the application target and plasma enclosure is eliminated.

The precise chemical/biological reaction mechanism between the plasma plume and the target, which produces the aforementioned beneficial effects, is still under investigation. Several theories have been proposed.

According to one theory, the presence of various gases along with moisture in the air produce several chemically reactive species in the plasma plume that react with the target. Chen's work shows that the plasma effluent of the plume carries an abundance of reactive atomic oxygen (RAO), which is the catalyst for plasma medical effects. As RAO reacts with $H_2O$ in blood, it produces $H_2O_2$. Some of the $H_2O_2$ is decomposed to oxygen, which dissolves into tissue to increase oxygen tension. $H_2O_2$ also triggers fibroblast growth factor, platelet derived growth factor and other factors to induce reactions such as inflammation and angiogeneis. As a result, the healing process is improved and healing time is reduced. Chen C., Air Plasma Effects on Bleeding Control and Wound Healing, PhD Thesis, Department of Electrical Engineering, Polytechnic Institute of NYU, June 2011, UMI Number: 3457994.

According to another theory, radicals in plasma support the endogenous radical-mediated defenses and healing mechanisms of tissue and derive the formation of cell mediators such as nitric oxide. For example, Laroussi et al. concluded that for non-equilibrium, atmospheric air plasmas, oxygen-based and nitrogen-based reactive species played the most important role in the bacterial inactivation process Lederer E., Plasma Blows Wounds Clean, http://news.doccheck.com/com/article/211278-plasma-blows-wounds-clean/.

According to Soffels et al., plasma releases controllable amounts of short-lived reactive oxygen (ROS) and nitrogen (RNS) species that address only the target areas in the tissue. Each of these species has different physiological functions such as antibacterial, pro-apoptotic, pro-inflammatory (ROS), or anti-inflammatory and pro-apoptotic (RNS). External administration of ROS or RNS by plasma locally reinforces the natural physiological processes. Stoffels E., Roke A. J. M., Deelman L. E., Delayed Effects of Cold Atmospheric Plasma on Vascular Cells, Plasma Processes and Polymers, No. 5, 2008, 599-605.

Regardless of the mechanism, it has been experimentally confirmed that plasma treatment conditions can be tuned to achieve many desired medical effects, especially in medical sterilization and treatment of different types of skin diseases. Plasma treatment conditions may be tuned by, for example, varying the treatment conditions and/or plasma characteristics including the degree of ionization, electron's temperature, gas temperature, input power (voltage) of the generator, input gas composition, exposure time to the plasma plume, and distance between the plasma plume and the target.

In general, prior art plasma generators use two electrodes, such as parallel, metallic plates, separated by a dielectric material. Typically, the electrodes are fixed relative to one another, which stagnant configuration produces the same plume characteristics for a give set of input values. It would be desirable to provide a plasma generator having one or more electrodes that are movable, which relative movement provides another means of changing or tuning the characteristics of the plasma plume.

Many prior art plasma generators also require high input power, complex heavy-duty pulse generators, amplifiers, or complicated RF generators in order to create the plasma-generating electric field. Such electrical requirements greatly inhibit the portability of such devices and significantly add to the cost of production. Therefore, it would be desirable to provide a plasma generator that has basic components and low power requirements so that the device can operate portably with a low voltage battery source.

SUMMARY OF THE INVENTION

The present invention provides devices for producing uniform, non-equilibrium plasma and discharging a plasma plume at atmospheric pressure. The devices include means for adjusting properties of the plasma plume exiting therefrom including one or more of the following: gas temperature; length; size; degree of ionization or relative presence of various radicals; and uniformity of plasma. Because the plasma plume can be adjusted, the device has broad medical applications including sterilization, wound healing, inactivation of bacteria, surgery, and surface treatment and engineering applications including ozone generation.

In a preferred embodiment, the device comprises a dielectric barrier discharge plasma generator that is capable of producing an adjustable plasma plume in open air at atmospheric pressure. Preferably, the plasma generator can produce a relatively long plasma plume using several different source gases including helium, argon, and nitrogen. Because the device produces a plasma plume in open air at atmospheric pressure, it can be operated without vacuum systems surrounding the target site. Open air operation also produces many radicals and ion species that are important for several medical applications.

Because the device produces uniform, non-equilibrium (cold) plasma in preferred embodiments, the device can be used for applications where high-temperature, high-pressure plasma discharges are inappropriate. For example, in medical applications, thermal diffusion to tissue adjacent the target can be eliminated and damage limited by adjusting the gas flow rate and the gas temperatures of the exiting plume.

In other preferred embodiments, the device is small and portable. Due to its small size, the device produces a plasma plume that is localized and precise, and does not damage the area surrounding the target. The device includes a probe that can be held in a single hand and easily manipulated by the operator. The associated accessories, such as the power source and gas source, can fit on a movable cart, or be incorporated within the probe, so that the system is portable.

In another preferred embodiment, the device has low power requirements and does not require heavy-duty pulse generators, amplifiers, or complicated RF generators. The device can be operated with a low voltage DC power such as a 12 volt battery. The frequency of the output voltage may be about 1 kHz to about 100 kHz. This low power requirement ensures that the plasma plume can be safely placed in direct contact with living tissue and delicate surfaces including living flesh, skin, and wounds. The plasma device is essentially electrically neutral since the plasma plume induces electrical currents in the target on a microamp level.

In an additional preferred embodiment, the device uses low gas flow rates, preferably less than 1.0 standard liters per minute (SLPM), which minimizes the device's operating cost. The device's low pressure requirements also eliminates damage to exposed delicate tissues, which may be caused by over-pressurization of the gas plume contacting the exposed surface.

In yet another preferred embodiment, the device includes nozzle means for projecting the plasma plume from the tip of the hand-held probe in either the radial or axial direction. This feature gives the operator greater maneuverability in small spaces such as surgery and dentistry.

Similar to most DBD generators, the device produces plasma by applying an electric field between two electrodes. In an additional preferred embodiment, one electrode has means for generating a plurality of separate, high-intensity electric fields along at least a portion of its surface. These multiple electric fields break down and create a controllable, uniform plasma inside the plasma generator that is expelled through an exit port into open air. This construction requires far less power than prior art plasma generators. In one preferred embodiment, the electric field generating means comprises a plurality of equally-spaced protrusions electrically-connected to and transversely-extending from at least a portion of the inner electrode base. The protrusions may comprise wire bristles having a cross-sectional area that is much less than the cross-sectional area of the inner electrode base.

In still another preferred embodiment, one electrode is movable relative to the other so that the location of plasma generation within a dielectric tube can be changed. Movement of the electrode changes the characteristics of the plume including generation of various radicals and species in the plasma plume.

In one preferred embodiment the device comprises a gas source, a power source, and a plasma generator probe having a central axis, a proximal end, and a distal end from which the plume of plasma is discharged. The probe includes an elongate housing, an elongate, dielectric ionization conduit, an elongate inner electrode, and an outer electrode that is slidably arranged on the outer surface of the ionization conduit and electrically connected to the power source. The electrodes are constructed and arranged so that movement of the outer electrode relative to the inner electrode changes at least one property of the plasma plume.

The housing has a central axis, an open distal end and a proximal end. The ionization conduit has a central axis arranged in coaxial relationship within the housing. The ionization conduit has a port at an open discharge end proximate the open discharge end of the housing, and a proximal end arranged in sealed fluid communication with the plasma gas source.

The inner electrode extends within the ionization conduit, and has a distal end proximate the distal end of the housing and a proximal end electrically connected to the power source. The distal portion of the inner electrode has a construction that is different than a proximal portion, and is located proximate the ionization conduit port.

In this preferred embodiment, the central electrode has an elongate base extending generally parallel to the central axis of the ionization tube and has a plurality of bristles electrically-connected to and transversely-extending from at least a portion of the electrode base. The bristles have a cross-sectional area that is much less than the cross sectional area of the electrode base. The length of the bristle portion is greater than the axial length of the outer electrode.

The length of the bristles ranges from about 200 microns to 1 mm and the density of the bristles along the base ranges from about 10 bristles/mm to about 20 bristles/mm. In this embodiment, the bristles are integrally formed with the electrode base. However, in other embodiments, the bristles and base are separate, electrically-connected elements and may be made from different electrically-conductive materials. In one preferred embodiment, the bristles are spaced equally from one another along the length and around the perimeter of the pin portion.

The outer electrode can be slid axially between a first limit position aligned with the inner electrode distal portion and a second limit position aligned with the inner electrode proximal portion. 15. In one preferred embodiment, the outer electrode can slide along the entire length of the bristle portion.

In one preferred embodiment, the housing and dielectric ionization conduit comprise cylindrical tubes having a generally concentric arrangement. The outer electrode comprises an annular ring having an inner diameter larger than the outer diameter of the ionization tube and an outer diameter smaller than the inner diameter of the housing tube. The radial distance between the inner electrode and the inner surface of the outer electrode is between about 5 to 10 mm. The axial length of the annular ring is about 1 to 15 mm.

In another preferred embodiment, the device includes a diverter nozzle connected to the open distal end of the housing that changes the flow direction of the plasma plume. Alternatively, or additionally, the diverter also divides the plume into more than one flow direction.

DETAILED DESCRIPTION OF PREFERRED EMBODIMENT(S)

Figure 1:
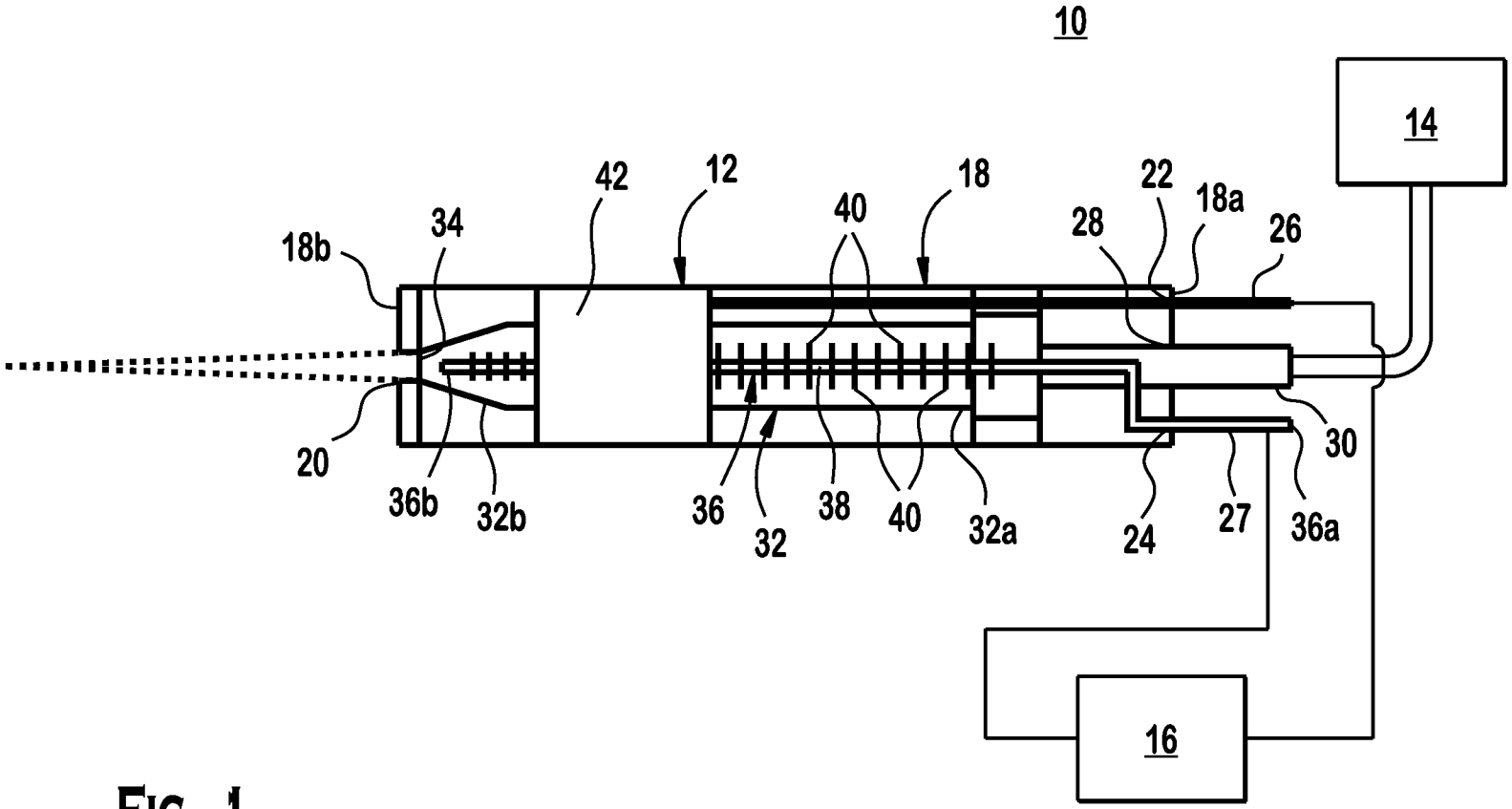
FIG. 1 is a schematic illustration of a plasma generating device in accordance with a preferred embodiment of the invention.

For the purpose of illustrating the invention, several embodiments of the invention are shown in the accompanying drawings. However, it should be understood by those of ordinary skill in the art that the invention is not limited to the precise arrangements and instrumentalities shown therein and described below. Throughout the specification, like reference numerals are used to designate like elements. Throughout the specification, as used in connection with various elements and portions of elements, the terms "distal" and "proximal" refer to their spatial relationship relative to the end of the generator probe into which gas is input and opposite the end from which plasma is discharged. The term "plume temperature" means the temperature of the gas within the plume.

An apparatus for generating a uniform, non-equilibrium plasma plume in accordance with a preferred embodiment of the invention is schematically illustrated in FIG. 1. The apparatus, designated generally by reference numeral 10, comprises a dielectric barrier discharge (DBD) plasma generator probe 12, a plasma gas source 14, and an electric power source 16. The plasma plume 8 is discharged from the probe 12 at atmospheric pressure. The generator probe 12 can be held in one hand and easily manipulated relative to the treatment target.

Referring to FIG. 1, the plasma generator probe includes an elongate housing 18 having a central axis, a proximal end wall 18*a* and a distal end wall 18*b* from which the plasma plume 8 is discharged. The plasma plume 8 can be characterized by measuring the plume temperature, plume length, and emission spectra as a function of input power, axial position of the outer annular electrode, the type of gas, and the gas flow rate through the generator probe 12.

The housing 18 may be made of any material having sufficient rigidity to support the probe's internal components and be hand held by the operator. The housing 18 should also preferably be made of an insulating material. For example, the housing 18 may be made from a thermoplastic used to make precision parts requiring high stiffness, low friction and excellent dimensional stability such as polyoxymethylene. The distal end wall 18*b* of the housing 18 includes an exit port 20 through which the plasma plume 8 is expelled. The proximal end wall 18*a* of the housing 18 includes sealed apertures 22, 24 through which electrical connector cables 26, 27 extend, and a port 28 through which a gas supply tube 30 extends. The housing 18 is otherwise sealed.

An elongate, dielectric ionization conduit 32 is arranged in a generally coaxial relationship with the housing 18. The conduit 32 has a port 34 at a distal discharge end 32*b*, which tapers in the form of a concentrating nozzle. The port 34 in the conduit aligns with the exit port 20 in the distal end of the housing 18. The proximal end 32*a* of the conduit is connected in sealed fluid communication with the gas supply tube 30. The ionization conduit is made from a dielectric material such as glass or machinable ceramic that can withstand high temperatures.

An elongate inner electrode 36 extends within the ionization conduit 32. The distal end 36*b* of the electrode 36 is positioned near the distal port 34 in the ionization conduit 32. The proximal end 36*a* of the electrode 36 is located near the proximal end 18*a* of the housing 18 and connects to the power supply 16 via a connector cable 27.

The inner electrode 36 has an elongate base 38 extending generally parallel to the central axis of the ionization conduit 32. The inner electrode 36 also includes means for generating a plurality of separate, high-intensity electric fields along the length and around the perimeter of the electrode base 38. The generating means may comprise a plurality of electrically-conductive bristles 40 fixed to and extending radially from the electrode base 38. The electrode base 38 and bristles 40 may be made from an electrically conductive material such as copper, stainless steel, or aluminum. The base 38 and bristles 40 preferably are, but need not be, made from the same electrically-conductive material. The base 38 need not be integrally formed with the bristles 40 so long as they are connected in electrical conductivity. Preferably, the cross-sectional area of the bristles 40 is less than the cross-sectional area of the base 38.

In the preferred embodiment shown in FIG. 1, the bristles 40 are equally spaced both axially and radially on the electrode base 38 and along the entire length of the base 38 located within the ionization conduit 32. However, in other preferred embodiments, the bristles 40 may be provided on less than the entire length of the base 38 without departing from the scope of the invention. Furthermore, the bristles 40 may be spaced unequally but in a defined pattern along the axial length of the base 38. For example, the spacing between bristles 40 may increase/decrease exponentially or factorially along the base 38 length. In other less preferred embodiments, the bristles 40 are randomly spaced along the base length. The size (length or cross section) and shape of the bristles 40 may also vary along the length of the inner electrode.

The size of the bristles 40 may vary depending on the intended application. In preferred embodiments, the length of the pins may range from 200 microns to 1 mm, and preferably be less than 1 mm. The diameter of the bristles may also range from 1 mm to a few mm.

The number of bristles per unit length of inner electrode, i.e., density, may vary depending on the intended application. For example, the density of the bristles 40 may vary from a few per mm to several dozen per mm along the inner electrode base. Embodiments with higher pin density will have more uniform plasma production in the region between the outer and inner electrode.

The total number of bristles, and the length of electrode base 38 connected to bristles 40, may also vary depending on the intended application. For example, in the embodiment shown in FIG. 1, the entire length of inner electrode contained within the ionization conduit 32 is connected to bristles 40. However, in the embodiments shown in FIGS. 3-6 and 11-12, the bristles 140 are only connected to a distal portion of the inner electrode base.

An outer electrode 42 is slideably arranged on the outer surface of the ionization conduit 32 and connected to the power source 16 by a connector cable 26. The outer electrode 42 has an inner shape and dimension that compliments and is slightly larger than the outer shape and dimension of the ionization conduit 32. The outer electrode 42 also has an outer shape and dimension that compliments and is slightly smaller than the shape and inner dimension of the housing 18. These complimenting shapes and sizes allow the outer electrode to slide axially along the length of the ionization conduit 32.

The outer electrode 42 may be made of an electrically-conductive material such as stainless steel, copper, or aluminum. The outer electrode may, but need not be, made from the same electrically-conductive material as the inner electrode 36.

In the embodiment shown in FIG. 1, the power source 16 comprises a remote device wired to the generator probe 12. However, in other preferred embodiments, the power supply may be attached to or incorporated into the probe housing 18.

Figure 2:
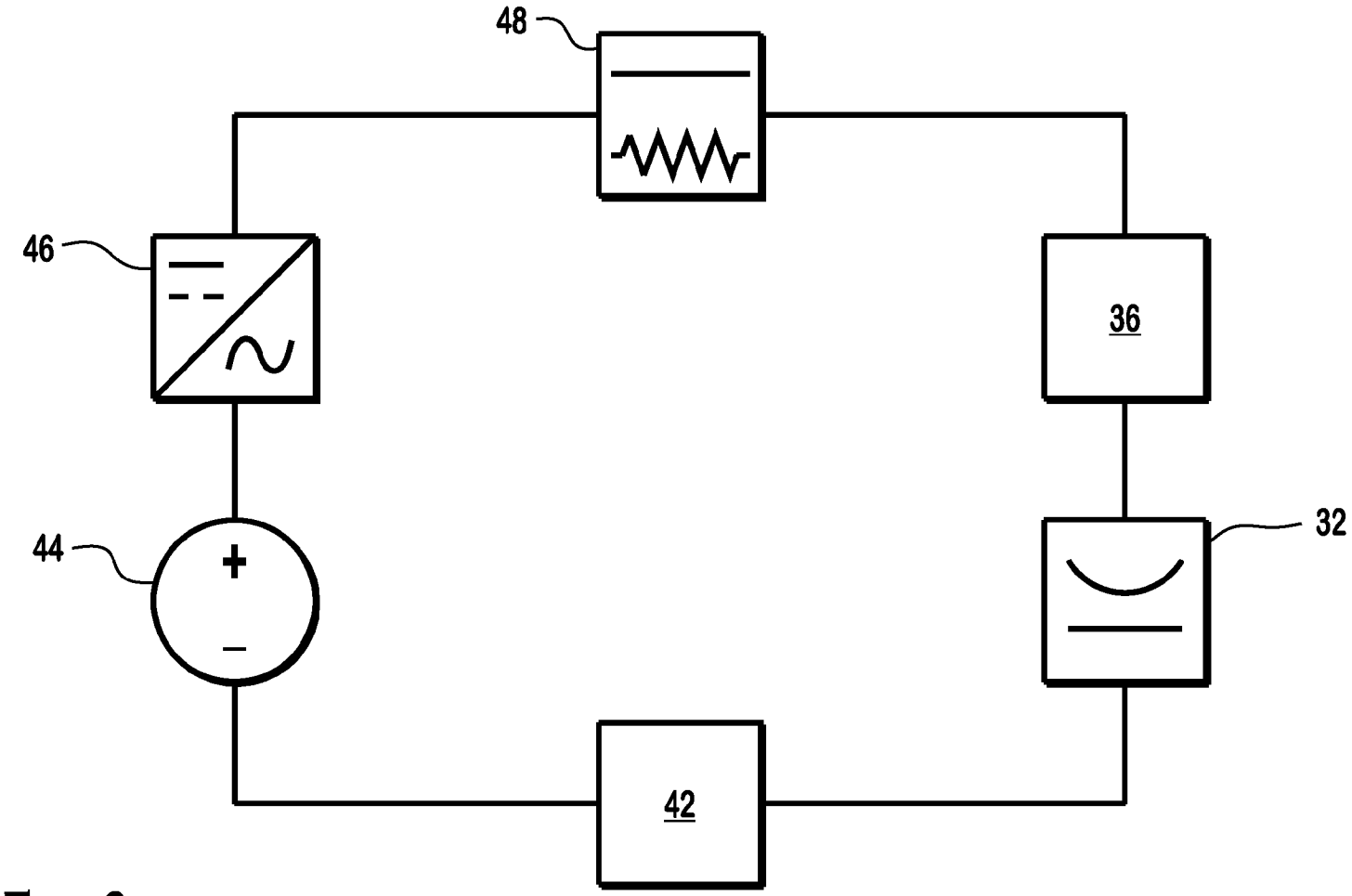
FIG. 2 is an electrical schematic of the power circuit of the device show in FIG. 1.

A schematic diagram of the power circuit of a preferred embodiment is shown in FIG. 2. The power supply comprises a low-voltage, direct current battery 44, a DC/AC converter 46, and a ballast resistor 48. The power supply preferably produces AC voltages from 1 kV to about 12 kV and may vary in frequency from about 1 kHz to about 100 KHz. The ballast resistor value may range from about 10 k Ohm to about 100 k Ohm. In a preferred embodiment, the battery comprises a common 12 volt battery. The AC power supply may have means to control the frequency and amplitude of the voltage signal. In another embodiment, the AC power supply includes means to vary the frequency and the amplitude of the signal independently.

In one preferred embodiment, the gas source 14 comprises a pressurized tank of a nitrogen, helium, argon or other gas known for producing plasma. The gas source 14 preferably includes a valve(s) and gas flow meter(s) to monitor and regulate the pressure and flow rate of gas through the generator probe 12. The pressurized gas may also comprise air; however, as discussed below, the input power required to ionize air is much higher than for ionizing argon, helium or nitrogen.

The gas pressure may be adjusted to achieve low gas flow rates and to avoid over-pressurization, i.e., plasma pressure/velocity that damages the target, especially in medical applications. For example, for very sensitive applications, the gas flow rate can be adjusted to about 1 SLPM to about 5 SLPM. For other less sensitive applications, the gas flow rate may be adjusted up to 15 SLPM or higher.

When the power source 16 is energized, a voltage differential is created between the inner 36 and outer 42 electrodes. The electrical discharge between the inner and outer electrodes creates a uniform and controllable DBD plasma discharge in the ionization conduit 32, which is expelled from the exit port 20 in the housing 18. The plasma is non-equilibrium and weekly ionized. The plasma created in the ionization conduit is not an arc plasma, which is usually rendered as an equilibrium plasma having very high gas and electron temperatures (ranging from 0.5 eV to several electron volts). Instead, as voltage is applied across the electrodes, streamers momentarily initiate at the tip of each bristle 40 on the inner electrode 36. The streamers propagate towards the dielectric surface, i.e., inner surface of the ionization conduit 32. Due to charging of the dielectric surface, streamers do not have sufficient time to convert into arcs. Since the charge is not removed by any conductor, the current ceases and a new breakdown occurs at the tip of bristles 40, thereby sustaining the plasma inside the ionization conduit 32.

The input power required to create the uniform and controllable DBD plasma discharge in the ionization conduit 32 varies depending on the input gas. For common plasma producing gases such as nitrogen, helium, and argon at very low pressures, the input power requirement is very low, e.g., up to tens of Watts; however, if air is used to produce the plasma plume, the input power requirement is much higher, e.g., up to hundreds of Watts.

Plasma production within the ionization conduit 32 occurs in the region of overlap (axial alignment) between the inner 36 and outer 42 electrodes. Plasma production does not initiate on any of the bristles 40 that are non-overlapping with the outer electrode 42. Because the axial location of the outer electrode 42 can be adjusted relative to the inner electrode 38, the location within the ionization conduit at which plasma is produced can also be adjusted. By varying the plasma production location, at least one property of the exiting plasma plume can be adjusted. By changing the axial location along the inner electrode 36 at which ionization occurs, the plume temperature, length, and degree of ionization of the exiting plasma plume 8 can be adjusted and controlled to suit a particular application. For example, when the outer electrode 42 is positioned very close to the exit port 20 in the housing 18, a very intense, relatively-high temperature plasma plume is produced. Conversely, when the outer electrode 42 is positioned far away from the exit port 20, a less intense, lower temperature plasma plume exits the probe 12. The properties of the plasma plume can also be adjusted and controlled by varying the gas type, the gas flow rate through the ionization conduit 32, and input voltage.

An apparatus for generating a uniform, non-equilibrium plasma plume from a gas source and power source in accordance with another embodiment of the invention is shown in FIGS. 3-6. The apparatus comprises a dielectric barrier discharge plasma generator probe 112 having a construction similar to the probe 12 disclosed above. The probe 112 connects to a plasma gas source and an electric power source such as the gas source 14 and power source 16 disclosed above. The plasma plume 8 is discharged from the probe 112 at atmospheric pressure.

Referring to FIGS. 3-6, the plasma generator probe 110 includes an elongate, tubular housing 118 having a central axis, a proximal end wall **118*a* and a distal end wall 118*b* from which the plasma plume is discharged. In this embodiment, the housing 118 is made of polyoxymethylene, which has high stiffness, low friction and excellent dimensional stability. The distal end wall 118*b* of the housing 118 includes an exit port 120 through which the plasma plume 8 is expelled. The proximal end wall 118*a* of the housing 18 includes an aperture 122 through which an electrical connector cable 126 extends, and a port 128 through which a Y-shaped gas supply connector 130 extends. The housing 118 is sealed around the cable 126 and Y-connector 130**.

Figure 3:
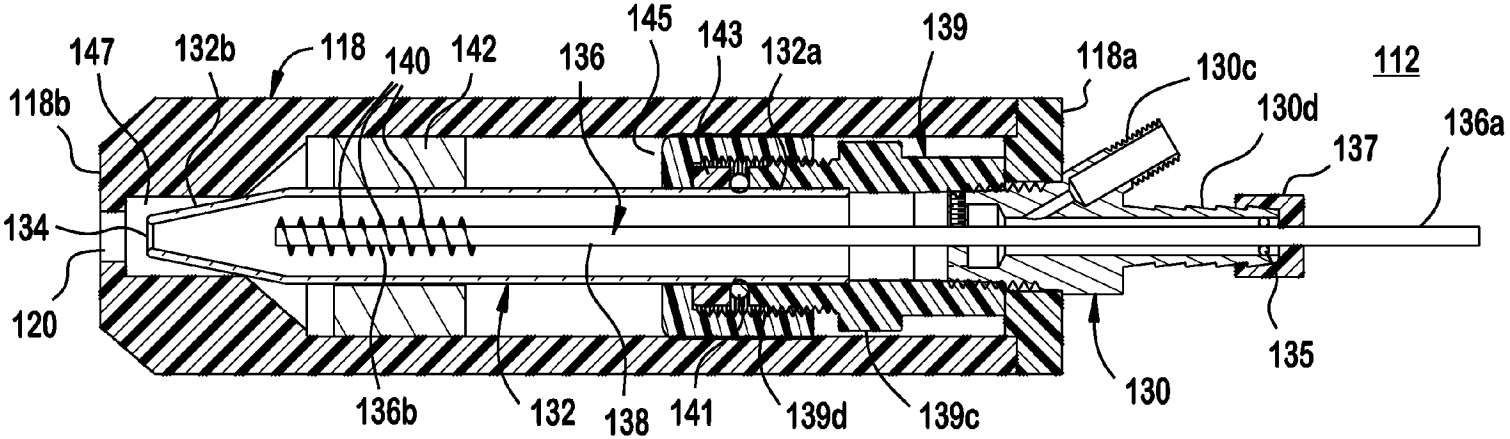
FIG. 3 is a cross-sectional view of a plasma generating probe in accordance with another preferred embodiment of the invention.
Figure 4:
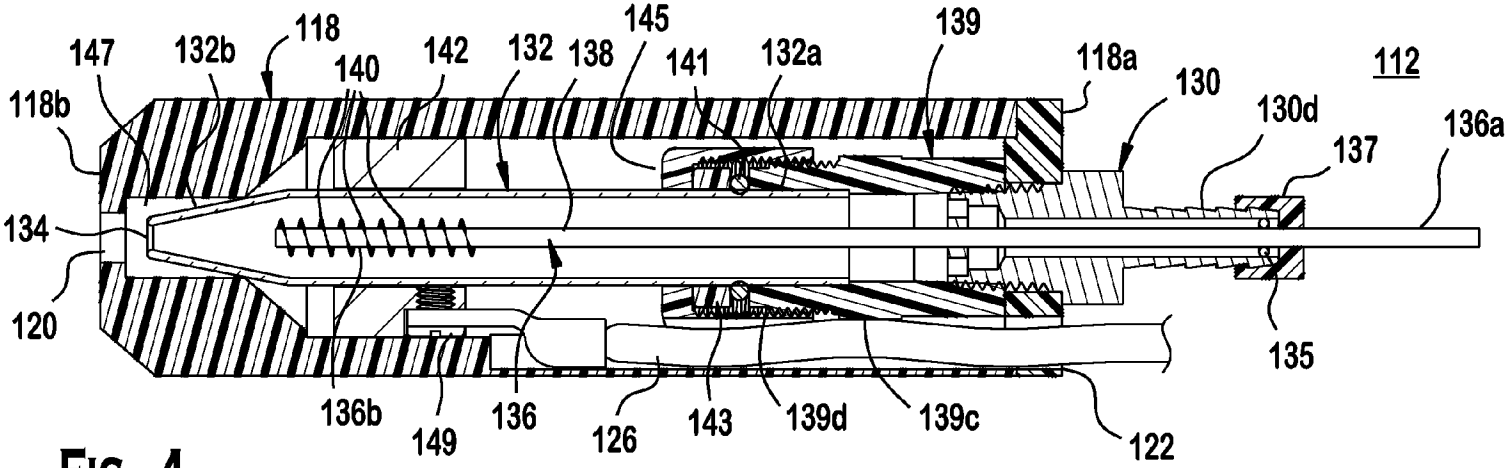
FIG. 4 is another cross-sectional view of the plasma generating probe of FIG. 3.
Figure 5:
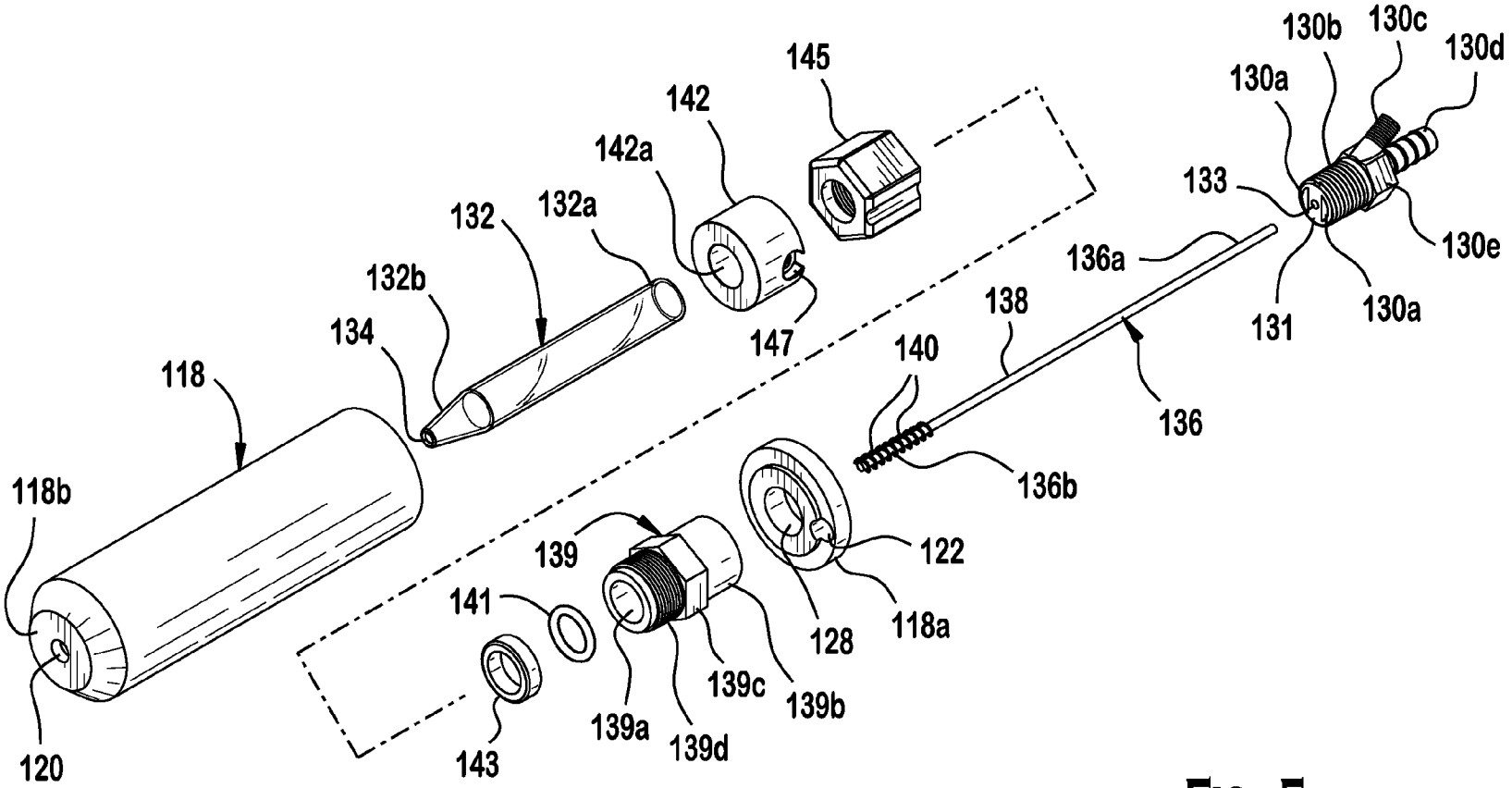
FIG. 5 is an exploded assembly view of the main components of the plasma generating probe of FIG. 3.
Figure 6:
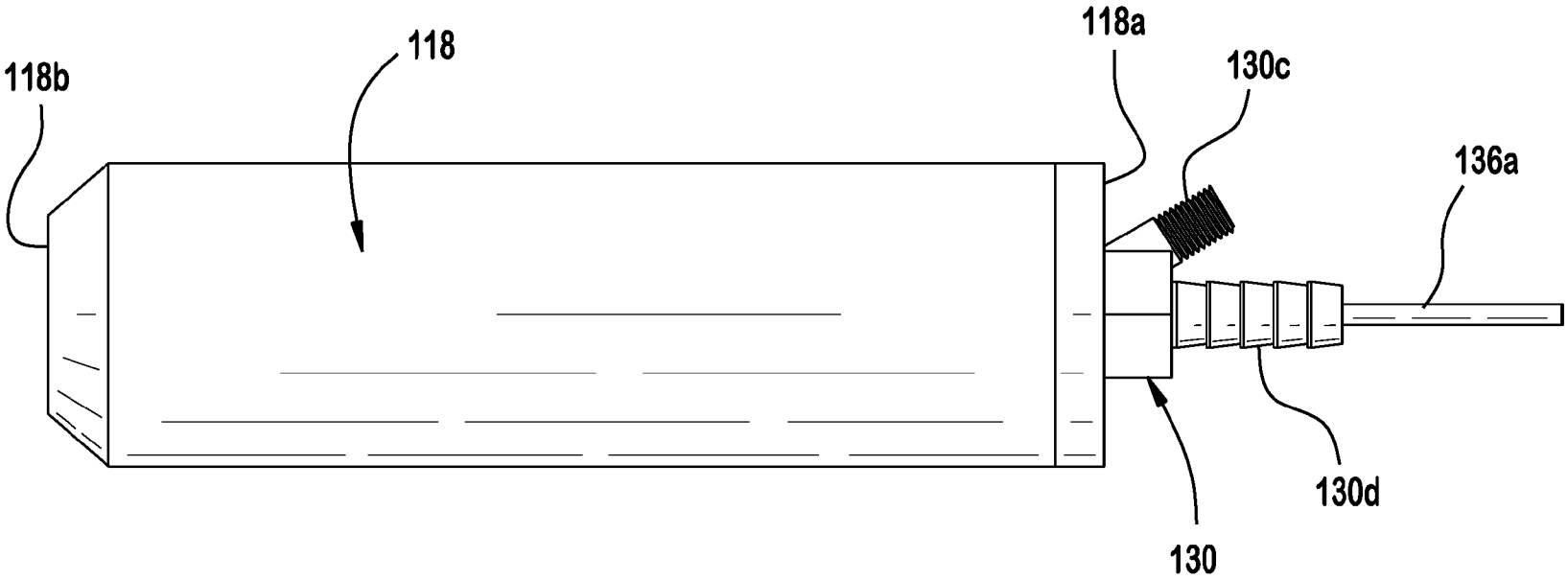
FIG. 6 is a side elevation of the main components of FIG. 5 shown in an assembled condition.

The Y-connector 130 has a central axis and aperture **130*a* extending through a threaded trunk portion 130*b*, which then splits into a threaded branch portion 130*c* and a barbed branch portion 130*d*. A rib 131 traverses the central aperture proximate the open end of the trunk portion 130*b* as best seen in FIG. 5. The rib 131 includes a central axial bore 133 slightly larger than the outer diameter of the central electrode 136. The rib 131 is narrow enough so that the central aperture 130*a* is not completely blocked as seen in FIG. 5. The Y-connector 130 has a central, hexagonally-shaped shoulder portion 130*e*, which abuts and seals to the proximal end plate 118*a* as best seen in FIGS. 3 and 4. The threaded branch portion 130*c* connects to the gas source such as 14 via a flexible gas line (not shown). An O-ring 135 and cap 137 seal the proximal end of barbed branch portion 130*d* around the central, inner electrode 136**.

The threaded trunk portion **130*b* of the Y-connector 130 cooperatively engages the proximal end 139*b* of an ionization tube mount 139. The tube mount 139 has a central axis and aperture 139***a*, a proximal female threaded portion 139*b*, a hexagonally-shaped shoulder portion 139*c*, and a distal male threaded portion 139*d*. As best seen in FIGS. 3 and 4, the Y-connector 130 and tube mount 139 clamp to opposed sides of the proximal end wall 118*a* of the housing 118.

An elongate, dielectric ionization tube 132 is mounted in the distal end 139*d* of the tube mount 139 in a generally coaxial relationship with the housing 118. The ionization tube 132 is made from blown glass. The ionization tube 132 has a generally-cylindrical shape, an open proximal end 132*a*, and an exit port 134 at a distal discharge end 132*b*, which tapers in the form of a concentrating nozzle. The port 134 in the conduit aligns with the exit port 120 in the distal end of the housing 118.

The proximal end 132*a* of the ionization tube 132 is connected in sealed fluid communication with the gas connector 130 by the tube mount 139. Referring to FIGS. 3-4, the outer diameter of the ionization tube 132 is smaller than the inner diameter of the tube mount 139. The proximal end 132*a* of the ionization tube 132 inserts into the distal end 139*d* of the tube mount 139 and is held in place by a compression fitting. In this embodiment, the compression fitting comprises an O-ring 141, a compression ring 143, and a compression nut 145 having female threads that cooperatively engage the distal male threaded portion 139*d* of the tube mount 139. The O-ring 141 surrounds and seals the outer surface of the ionization tube 132 when compressed by the compression ring 143 and nut 145 against the end surface of the distal portion 139*d* of the tube mount 139.

The distal end 132*b* of the ionization tube 132 is supported by the housing 118. In this embodiment, the tapered, nozzle end of the ionization tube sits in an annular pocket 147 that is adjacent and coaxial with the exit port 120.

An elongate inner electrode 136 is mounted by the Y-connector 130 in a generally coaxial relationship within the housing 118. The proximal end 136*a* of the inner electrode 136 extends completely through the Y-connector 130 and connects to the power supply 16 via a connector cable (not shown). The distal end 136*b* of the inner electrode 136 is positioned proximal the exit port 134 in the ionization tube 132.

The inner electrode 136 has an elongate base 138 extending generally parallel to the central axis of the ionization tube 132. The distal portion 136*b* of the inner electrode 136 has a plurality of electrically-conductive bristles 140 fixed to and extending radially from the electrode base 138. The electrode base 138 and bristles 140 are made from stainless steel. In this embodiment, the electrode comprises a modified hand-held cleaning and deburring tube brush comprising a single spiral of bristles 140 twisted between two wires that form the base 138.

In this embodiment, the base 138 and bristles 140 are formed from round wire. The diameter of the bristles is about 0.003 in. while the base diameter is about 0.094 in.

In this preferred embodiment shown in FIGS. 3-6, the bristles 140 are equally spaced both axially and radially on the electrode base 138. The bristles 140 are formed on only a distal portion 136*b* of the base measuring about 1 in. while the total inner electrode length is about 4 in.

An outer electrode 142 is slideably arranged on the outer surface of the ionization tube 132 and connected to the power source 16 by a connector cable 126. In this preferred embodiment, the outer electrode 142 comprises an annular ring having an inner bore 142*a* that is slightly larger than the outer diameter of the ionization tube 132, and an outer diameter that is smaller than the inner diameter of the housing 118. These complimenting shapes and sizes allow the outer electrode 142 to slide axially along the length of the ionization conduit 132.

In this preferred embodiment, the outer electrode 142 is made from stainless steel and has a length of about 0.645 in. A radial, threaded bore 147 receives a screw 149 that attaches the connector cable 126 in electrical connectivity to the outer electrode 142. As best seen in FIG. 4, the cable 126 has sufficient flexibility and slack to allow the outer electrode to translate about 1-2 inches.

Figure 7:
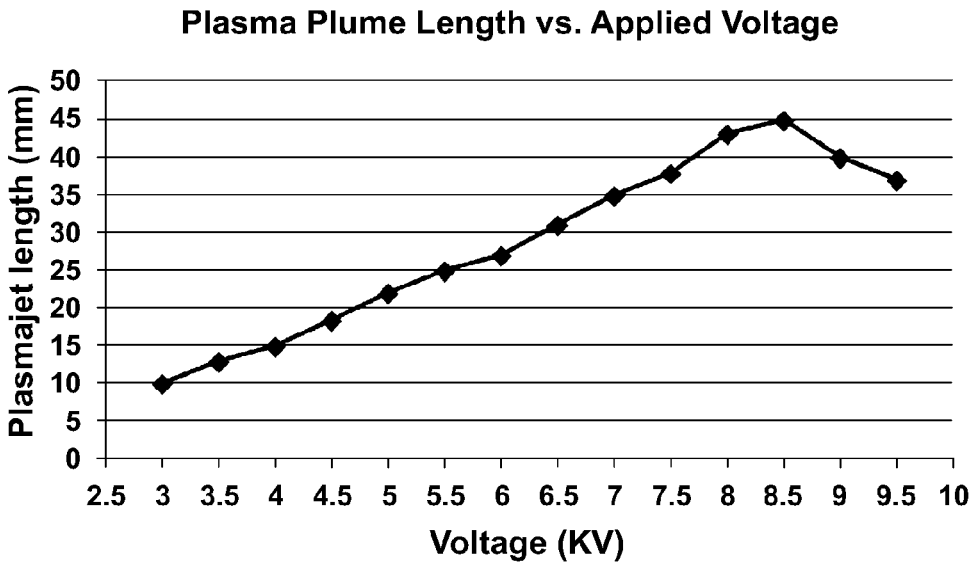
FIG. 7 is a chart comparing plasma plume length as a function of applied voltage of the power source.

The properties of the plasma plume can be adjusted and controlled by varying the gas type, the gas flow rate through the ionization conduit 32, the input voltage, and the location of the outer electrode 142 relative to the bristles 140 on the inner electrode. For example, the graph of FIG. 7 shows how the plume length can be varied by varying the input voltage. In this preferred embodiment, the plume length increases as the applied voltage increases; however, after a certain input voltage, the plasma plume becomes more intense but does not increase in length.

Similar to its dependency on input voltage, the plume length generally increases as the input pressure increases; however, after a certain input pressure, the plume length starts shortening. It is theorized that this effect is caused by turbulence within the ionization conduit at high flow rates. It is also theorized that the recombination rate for the charged radicals within the plasma is also dependent on the gas flow rate, applied voltage, and the axial distance traversed by the plasma within the ionization tube 132.

Figure 8:
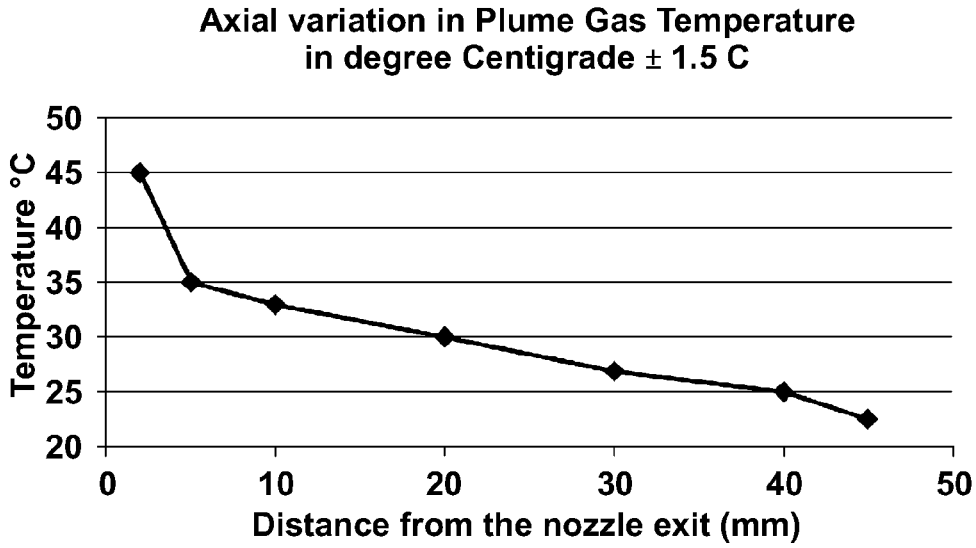
FIG. 8 is a chart comparing plume gas temperature as a function of distance from the nozzle exit.

In this preferred embodiment, the plume temperature is within acceptable and desired ranges for medical applications. The graph of FIG. 8 shows the plume temperature measured at various positions along its length. The distances are measured from the exit distal port 20. The applied voltage was ~8 kV with ballast resistor of 25 kΩ with argon at 0.8-1 SLPM. Argon gas was input at a flow rate of about 1 SLPM. The data shows, in general, that the plume temperature remains within an acceptable range necessary for medical applications including, but not limited to, wound treatment, sterilization, and blood coagulation. However, it should be appreciated that the data of FIG. 8 does not represent the full operating temperature range for the device. The temperature of the plasma jet can be varied by adjusting the operating parameters discussed above.

Figure 9:
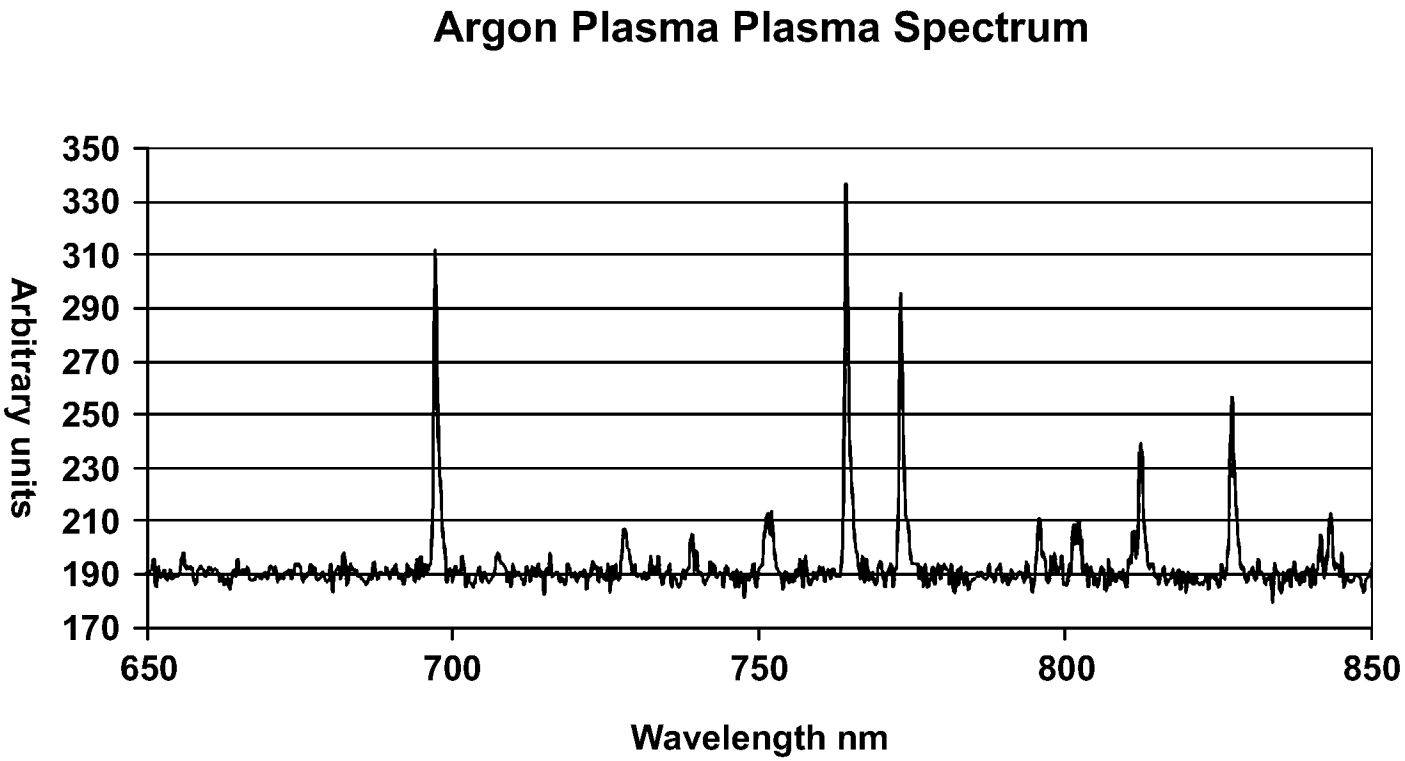
FIG. 9 is a chart showing the emission spectra of one plasma plume generated by the apparatus of FIG. 3.

In this preferred embodiment, the plume also contains radicals that are desirable for medical applications. The graph of FIG. 9 shows the spectral features of the plasma plume as measured proximate the distal port 120. Spectral features variation along the plume axial direction is not shown in FIG. 9. In this embodiment, the supply gas was argon. An Ocean Optics HR 4000CG-UV-NIR spectrometer was used to capture the spectral features of the plasma plume. A multimode optical fiber with a collimating lens mounted on its input end was used to capture the light from the plume. The output end of the fiber was directly connected to the spectrometer. FIG. 9 shows various argon lines that have been identified from the NIST data base. NIST Atomic Spectra Database: http://physics.nist.gov/cgi-bin/ASD/lines1.pl. It was found that the presence and the intensity of various lines in the spectral signature shown in FIG. 9 was heavily dependent on the axial position of the outer annular electrode, the applied voltage across the electrodes, the gas type, and the gas flow rate. The control of various radicals in the plasma jet generated by this device is important for medical applications where it has been shown that plasma releases controllable amounts of short-lived reactive oxygen (ROS) and nitrogen (RNS) species that address only the target areas in the tissue. Each of these species has different physiological functions. For example, ROS has antibacterial, pro-apoptotic, and pro-inflammatory properties. RNS has anti-inflammatory and pro-apoptotic properties.

It should be appreciated by those of ordinary skill in the art that the results shown in the graphs of FIGS. 7-9 are included only for the purpose of illustrating operation of the generator at certain operating conditions. The results do not, by any means, represent the full operating range for various parameters including gas flow rates, diameter of the exit nozzle, axial position of the outer annular electrode with respect to the nozzle exit, input power, electrode composition, and dielectric composition.

The plasma generating device described above also produces a large volume of ozone, which volume or percentage depends on the gas flow rates and the applied voltages across the electrodes. The presence of ozone can be increased or decreased by adding a small fraction of oxygen or air in the mainstream gas used in the system. Ozone plays a part of a cleaning/serializing agent in medical applications and its control gives an additional benefit in these applications. Running the plasma only on oxygen or air can turn it into an ozone generator that may have many applications in engineering including surgical equipment sterilization.

In this preferred embodiment, the proximal wall 118*a* of the housing 118 is not integrally formed with the main body of the housing 118. Instead, it has a shoulder that can be inserted into the end cavity of the main housing and held therein by friction. Alternatively, the proximal wall 118*a* of the housing 118 could be removably fixed to the end of the main housing body with other known fastening means. In these preferred embodiments, the axial position of the outer electrode is adjusted by removing the main outer housing body, manually sliding the outer electrode to the desired axial location, and then re-installing the main body of the housing.

Figure 10:
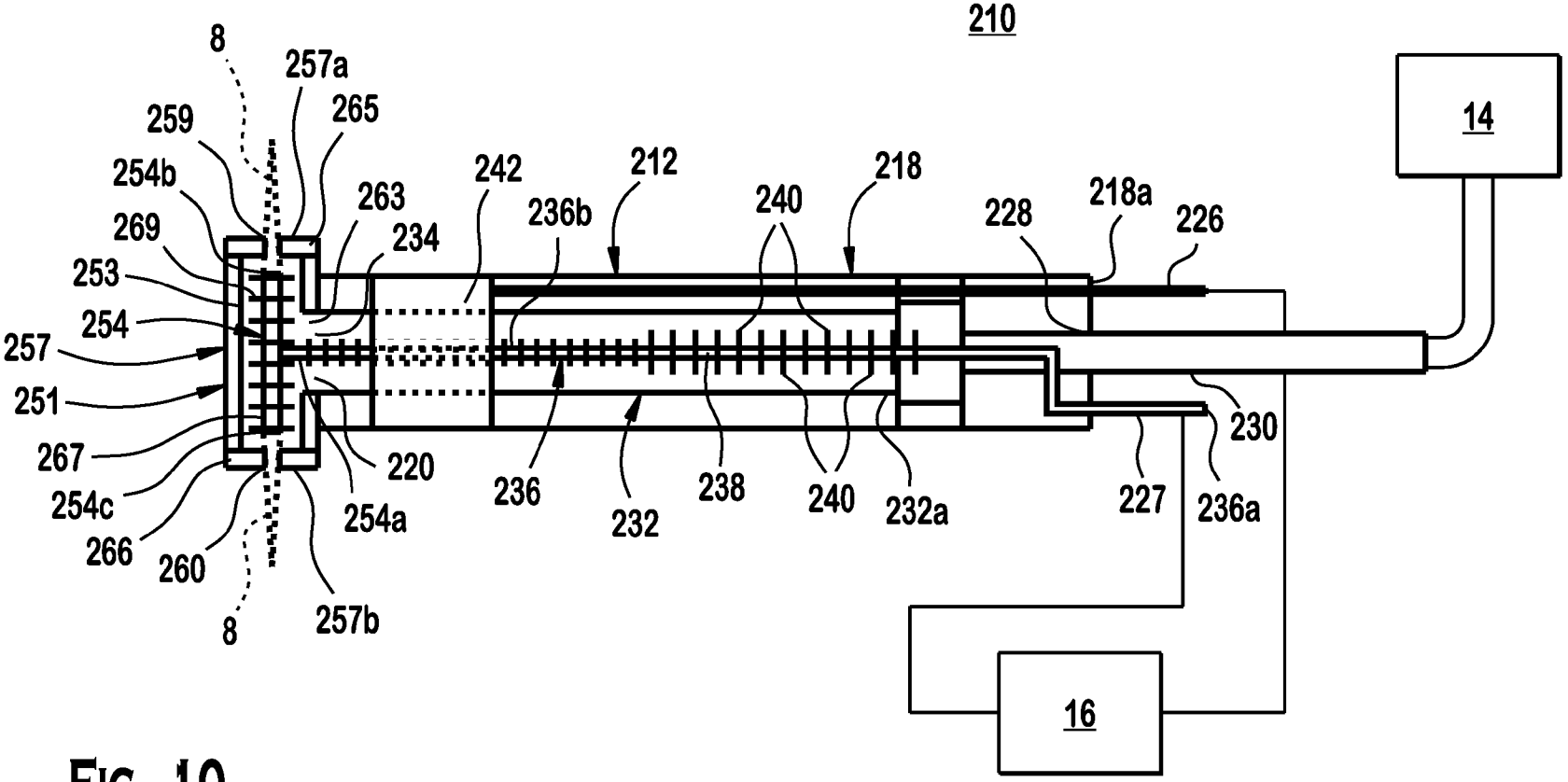
FIG. 10 is a schematic illustration of a plasma generating device in accordance with an additional preferred embodiment of the invention.

An apparatus for generating a uniform, non-equilibrium plasma plume in accordance with another preferred embodiment of the invention is schematically illustrated in FIG. 10. The apparatus, designated generally by reference numeral 210, comprises a plasma generator probe 212, a plasma gas source 214, and an electric power source 216. The plasma plume 8 is discharged from the probe 212 at atmospheric pressure. The generator probe 212 can be held in one hand and easily manipulated relative to the treatment target.

The generator probe 212 comprises a DBD plasma generator probe having a construction similar to the probes 12 and 112 disclosed above. However, in this embodiment, the probe 210 includes a nozzle 251 connected to the exit port 220 that changes the direction of the plasma plume 8 and/or bifurcates the plasma plume 8.

Referring to FIG. 10, the plasma generator probe 210 includes an elongate, tubular housing 218 having a central axis, a proximal end wall 218*a* and a distal end wall 218*b* to which the deflector nozzle 251 is attached. The distal end wall 218*b* includes an exit port 220 through which the plasma plume 8 flows into the nozzle 251. The proximal end wall 218*a* of the housing 218 includes apertures through which electrical connector cables 226, 227 extend, and a port through which a gas supply connector 230 extends. The housing 218 is sealed around the cables 226,227 and gas supply connector 230.

A primary dielectric ionization conduit 232 is arranged in a generally coaxial relationship with the housing 218. The conduit 232 has a port 234 at a distal discharge end 232*b*, which connects to the secondary ionization conduit 253 within the deflector nozzle 251. The proximal end 232*a* of the conduit 232 is connected in sealed fluid communication with the gas supply tube 230.

An inner electrode 236 extends within the primary ionization conduit 232. The distal end 236*b* of the electrode 236 is positioned near the distal port 234 and connects to the secondary inner electrode 253 (described below). The proximal end 236*a* of the primary inner electrode 236 is located near the proximal end 218*a* of the housing 218 and connects to the power supply 16 via a connector cable 226.

The inner electrode 236 has an elongate base 238 extending generally parallel to the central axis of the ionization conduit 232 and a plurality of electrically-conductive bristles 240 fixed to and extending radially from the electrode base 238. In the embodiment shown in FIG. 10, the bristles 240 are equally spaced both axially and radially on the electrode base 238 and along the entire length of the base 238 located within the ionization conduit 232. However, in contrast with the embodiment shown in FIG. 1, all of the bristles 240 do not have equal lengths. In this embodiment, the bristles at the proximal end of the inner electrode 236 are longer than the bristles near the distal end.

An outer electrode 242 is slideably arranged on the outer surface of the ionization conduit 232 and connected to the power source 16 by a connector cable 226. The outer electrode 242 has an inner shape and dimension that compliments and is slightly larger than the outer shape and dimension of the ionization conduit 232. The outer electrode 242 also has an outer shape and dimension that compliments and is slightly smaller than the shape and inner dimension of the housing 218. These complimenting shapes and sizes allow the outer electrode to slide axially along the length of the ionization conduit 232.

In the preferred embodiment shown in FIG. 10, the deflector nozzle 251 is attached to the distal end of the housing 218. The nozzle 251 acts as an extension of the ionization conduit 232 and changes the direction of the plasma plume 8 compared to the embodiments disclosed above. In this embodiment, the nozzle re-directs the plasma plume approximately 90 degrees relative to the longitudinal axis of the primary ionization conduit 232. In this embodiment, the nozzle 251 also bifurcates the plasma plume 8; however, in other embodiments the nozzle 251 re-directs the plume 8 without bifurcating or otherwise dividing the plume 8.

The nozzle 251 includes an elongate housing 257 having a central axis and opposed end walls 257*a*, 257*b*, each of which includes an exit port 259, 260 through which the plasma plume 8 is expelled. A secondary dielectric ionization conduit 253 is arranged in a generally coaxial relationship with the nozzle housing 257. The conduit 253 has ports at each end, which align with the exit ports 259, 260 in the housing 257. The nozzle 251 also has a port 263 in the side wall, which connects to the exit port 220 of the primary housing 218. Alignment of the ports 220 and 263 connects the primary ionization conduit 232 and secondary ionization conduit 253 in sealed fluid communication.

An inner electrode 254 extends within the nozzle ionization conduit 253. The electrode 254 has a "T" shape with a trunk end 254*a*, which is connected to the distal end of the primary inner electrode 236, and two branch ends 254*b*, 254*c* which are located proximate the exit ports 259, 260 in the nozzle 251. The inner electrode 254 has an elongate base 267 extending generally parallel to the central axis of the ionization conduit 253, and a plurality of electrically-conductive bristles 269 fixed to and extending radially from the electrode base 267.

A pair of outer electrodes 265, 266 are slideably arranged on the outer surface of the ionization conduit 253 and connected to the power source 16. The outer electrodes 265, 266 have an inner shape and dimension that compliments and is slightly larger than the outer shape and dimension of the ionization conduit 253. The outer electrodes 265, 266 also have an outer shape and dimension that compliments and is slightly smaller than the shape and inner dimension of the housing 257. These complimenting shapes and sizes allow the outer electrode to slide axially along the length of the ionization conduit 253.

In the embodiment shown in FIG. 10, the inner electrodes 236, 254 and outer electrodes 242, 265, 266 are connected in series to the same power source 16. However, in other embodiments, the electrodes of the primary ionization tube and nozzle may be connected in parallel to the same power source, or connected to different power sources. In yet other embodiments, the separate powers sources include means for controlling electrical input parameters including voltage, frequency, etc., for even more tuning control of the plasma plume.

In this preferred embodiment, the nozzle 251 can be rotated about the central axis of the primary housing 218 so that the plume 8 exits at any desired angle. This feature is particularly useful for medical applications where, for example, the target area is located within a small cavity that restricts the degree to which the housing may be tilted.

Figure 11:
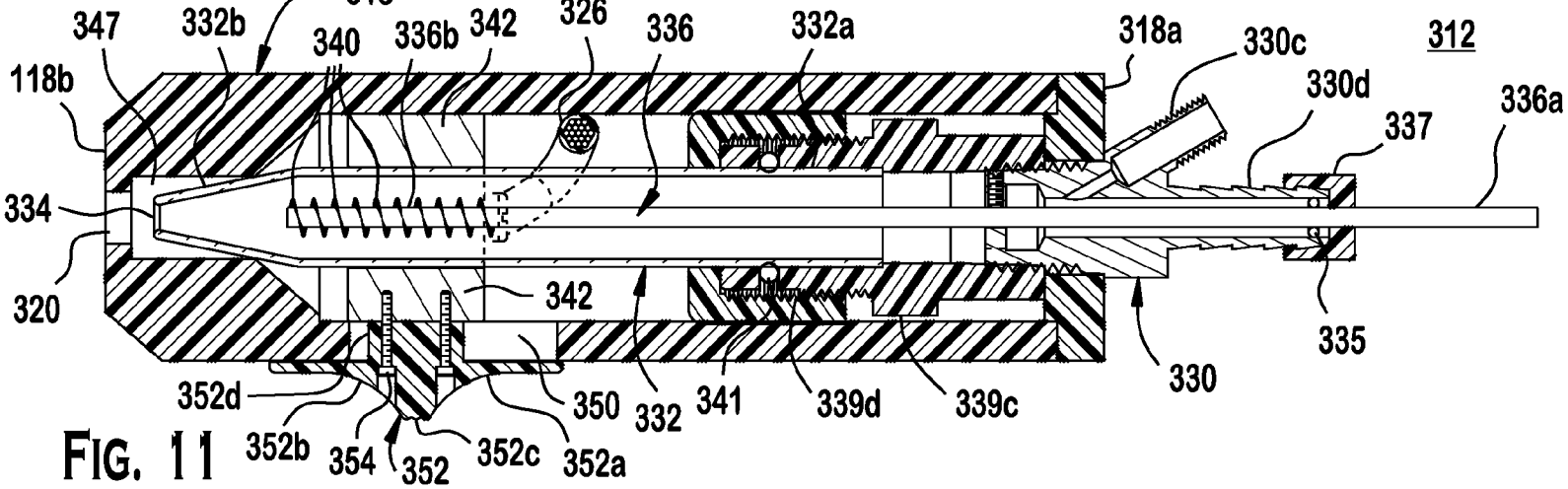
FIG. 11 is a cross-section of a plasma generating probe in accordance with yet another preferred embodiment of the invention.
Figure 12:
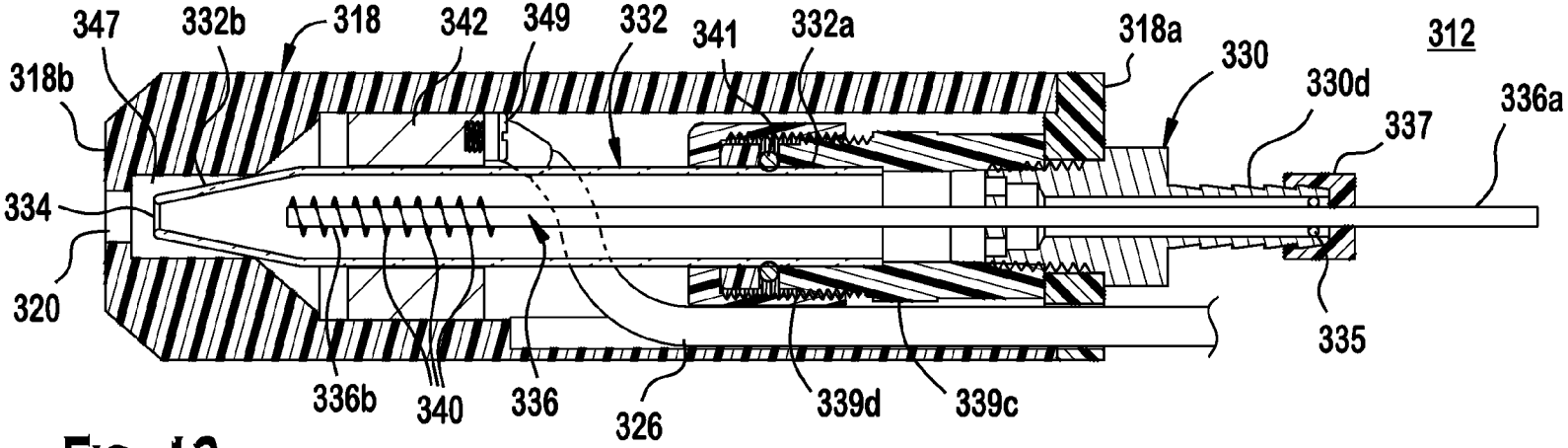
FIG. 12 is another cross-section of the plasma generating probe of FIG. 11; and, FIG. 13 is an enlarged, fragmentary view of the distal portion of the inner electrode showing the radially-protruding bristles.
Figure 13:
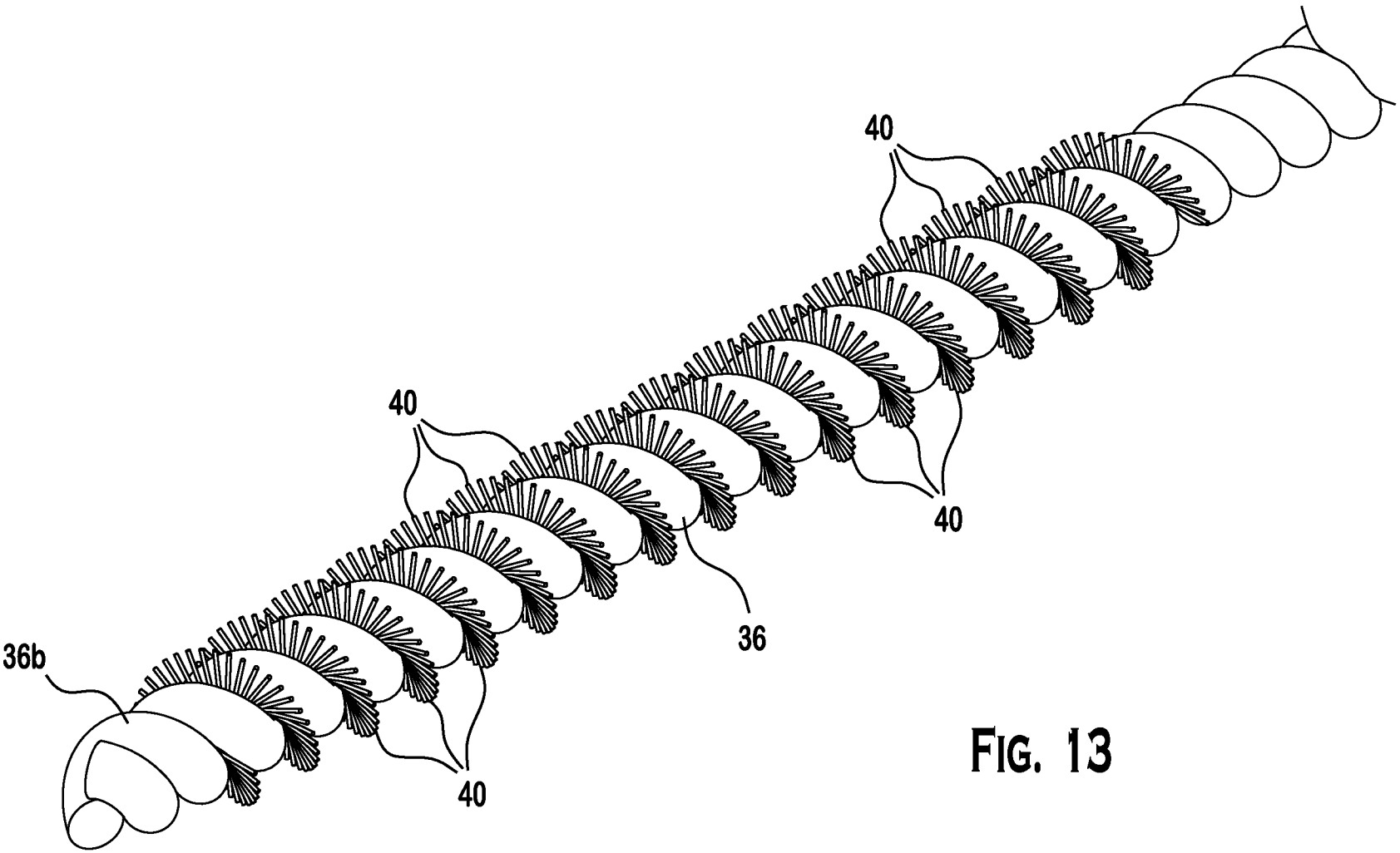

An apparatus for generating a uniform, non-equilibrium plasma plume from a gas source and power source in accordance with yet another embodiment of the invention is shown in FIGS. 11-12. The apparatus comprises a dielectric barrier discharge plasma generator probe 312 having a construction the same as the probe 312 illustrated and describe above with respect to FIGS. 3-6 except with the modifications described below. In this embodiment, the probe 312 includes means for manually adjusting the axial position of the outer electrode without disassembling the housing as described above with respect to the embodiment shown in FIGS. 3-6.

In this preferred embodiment, the gas connector 330, tube mount 339, O-ring 341, O-ring compression ring 343, compression nut 345, end cap 337, ionization conduit 332, inner electrode 336, and outer electrode 342 have the same construction as the gas connector 130, tube mount 139, O-ring 141, O-ring compression ring 143, compression nut 145, end cap 137, ionization conduit 132, inner electrode 136, and outer electrode 142.

The housing 318 has a construction similar to the housing 118 of the embodiment show in FIGS. 3-6; however, in this embodiment, the housing includes a longitudinal slot 350 in the radial wall of the housing 318. A thumb tab 352 is slideably mounted within the slot 350. The outer surface of the thumb tab 352 has a shape that compliments the thumb of an operator including contoured fore 352*a* and aft 352*b* surfaces divided by an elevated shoulder 352*c*. The inner surface 352*d* of the thumb tab 352 is connected to the outer electrode 342 with screws 354 or other means. The dimensions of the tab 352 and slot 350 are constructed to provide a resistive force that can be overcome by an average operator but will hold the outer electrode in place during normal use.

The length of the slot 350 preferably extends along the entire length of the inner electrode 336 that is connected to bristles 340. This construction allows the operator to manually slide the outer electrode 342 to any position in axial alignment with any portion of the bristled inner electrode 336. As described above, such movement of the outer electrode 342 will change the characteristics of the plasma plume. For a set of gas and power input parameters, the operator can fine tune the plasma plume during treatment by simply sliding the thumb tab fore and aft.

The foregoing is considered as illustrative only of the principles of the invention. Further, since numerous modifications and changes will readily occur to those skilled in the art, it is not desired to limit the invention to the exact construction and operation shown and described herein, and accordingly, all suitable modifications and equivalents may be resorted to, falling within the scope of the invention. For example, the generator probe may have two flat plate electrodes separated by a flat dielectric material. In this embodiment, any shape of dielectric tubes and any shape of electrodes may be incorporated in the probe provided one of the electrodes has very protuberances or bristles on which the electric field will concentrate to create tiny streamers that do not turn into arcs.

The invention claimed is:

1. A device for producing a plasma plume, comprising:

a) a gas source;

b) a power source;

c) a plasma generator probe having a central axis, a proximal end, and a distal end from which the plume of plasma is discharged, including:

i) an elongate housing having a central axis, an open distal end and a proximal end;

ii) an elongate, dielectric ionization conduit having a central axis arranged in coaxial relationship within said housing, said conduit having a port at an open discharge end proximate the open discharge end of the housing and a proximal end arranged in sealed fluid communication with said plasma gas source;

iii) an elongate inner electrode extending within said ionization conduit, said inner electrode having a distal end proximate the distal end of said housing and a proximal end electrically connected to said power source;

iv) an outer electrode slidably arranged on the outer surface of the ionization conduit, and electrically connected to said power source;

wherein said electrodes are constructed and arranged so that movement of the outer electrode relative to the inner electrode changes at least one property of the plasma plume.

2. The device recited in claim 1, wherein a distal portion of said inner electrode has a construction that is different than a proximal portion.

3. The device recited in claim 2, wherein the outer electrode can be slid axially between a first limit position aligned with said inner electrode distal portion and a second limit position aligned with said inner electrode proximal portion.

4. The device recited in claim 1, wherein said housing and said dielectric ionization conduit comprise cylindrical tubes having a generally concentric arrangement, and said outer electrode comprises an annular ring having an inner diameter larger than the outer diameter of said ionization tube and an outer diameter smaller than the inner diameter of said housing tube.

5. The device recited in claim 4, wherein the radial distance between the inner electrode and the inner surface of the outer electrode is between about 5 to 10 mm.

6. The device recited in claim 4, wherein the axial length of said annular ring is about 1 to 15 mm.

7. The device recited in claim 1, wherein said central electrode has an elongate base extending generally parallel to the central axis of said ionization tube and has a plurality of bristles electrically-connected to and transversely-extending from at least a pin portion of the electrode base.

8. The device recited in claim 7, wherein said bristles have a cross-sectional area that is less than the cross sectional area of said electrode base.

9. The device recited in claim 7, wherein the length of said bristles ranges from about 200 microns to 1 mm and the density of said bristles along the base ranges from about 10 bristles/mm to about 20 bristles/mm.

10. The device recited in claim 7, wherein said bristles are integrally formed with said electrode base.

11. The device recited in claim 7, where said bristles comprise a conductive material different than said electrode base.

12. The device recited in claim 7, wherein said bristles are spaced equally from one another along the length and around the perimeter of said pin portion.

13. The device recited in claim 7, wherein one end of said portion is located proximate the ionization conduit port.

14. The device recited in claim 7, wherein the length of said pin portion is greater than the axial length of the outer electrode.

15. The device recited in claim 7, wherein the outer electrode can slide along the entire length of the pin portion.

16. The device recited in claim 1, wherein the power source comprises a battery having a voltage up to 12 volts, and a ballast resistor.

17. A device for producing a plasma plume, comprising:

a) a plasma gas source;

b) a power source;

c) a plasma generator probe having a central axis, a proximal end, and a distal end from which the plume of plasma is discharged, including:

i) an elongate housing having a central axis, an open distal end and a proximal end;

ii) an elongate, dielectric ionization tube having a central axis arranged in coaxial relationship within said housing, said tube having a port at an open discharge end proximate the open discharge end of the housing and a proximal end arranged in sealed fluid communication with said plasma gas source;

iii) an elongate inner electrode extending within said ionization tube and having a distal end proximate the distal end of said housing and a proximal end electrically connected to said power source, said inner electrode having an elongate base extending generally parallel to the central axis of said ionization tube and a plurality of bristles electrically-connected to and transversely-extending from at least a pin portion of the electrode base;

iv) an outer electrode arranged outside the ionization tube, and electrically connected to said power source.

18. The device recited in claim 17, wherein said bristles have a cross-sectional area that is less than the cross-sectional area of said electrode base.

19. The device recited in claim 17, wherein the length of said bristles ranges from about 200 microns to about 1 mm, and the density of said bristles along the inner electrode base ranges from about 10 bristles/mm to about 20 bristles/mm.

20. The device recited in claim 17, wherein said bristles are integrally formed with said inner electrode base.

21. The device recited in claim 17, where said bristles comprise a conductive material different than said inner electrode base.

22. The device recited in claim 17, wherein said bristles are spaced equally from one another along the length and around the perimeter of the pin portion.

23. The device recited in claim 17, wherein one end of the pin portion is located proximate the ionization conduit port.

24. The device recited in claim 17, wherein the outer electrode is movable relative to the pin portion.

25. A plasma generator having a central axis, a proximal end, and a distal end from which the plume of plasma is discharged, comprising:

a) an elongate housing having a central axis, an open distal end, a proximal end, and a gas inlet port at the proximal end;

b) an elongate, dielectric ionization conduit having a central axis arranged in coaxial relationship within said housing, said conduit having a distal, discharge port proximate the open discharge end of the housing and a proximal end arranged in sealed fluid communication with said gas inlet port;

c) a power source;

d) an elongate inner electrode extending within said ionization conduit, said inner electrode having a distal portion proximate the distal end of said housing and a proximal portion connected to said power source;

e) means for generating a plurality of separate, high-intensity electric fields along the length and around the perimeter of the inner electrode distal portion; and, f) an outer electrode electrically connected to said power source and movable relative to said inner electrode;

wherein said electrodes are constructed and arranged so that movement of the outer electrode relative to the inner electrode changes at least one property of the plasma plume.

26. The device recited in claim 25, wherein the power source comprises an alternating current power supply that produces an output voltage of about 1 kV to about 12 kV.

27. The device recited in claim 26, wherein the frequency of the output voltage is about 1 kHz to about 100 kHz.

28. The device recited in claim 26, wherein said generating means comprises a plurality of equally-spaced protrusions electrically-connected to and transversely-extending from at least a portion of the inner electrode base.

29. The device recited in claim 28, wherein said protrusions comprise wire bristles having a cross-sectional area that is less than the cross-sectional area of said inner electrode base.

30. The device recited in claim 29, wherein the length of said bristles ranges from about 200 microns to about 1 mm, and the density of said bristles along the inner electrode base ranges from about 10 bristles/mm to about 20 bristles/mm.

31. The device recited in claim 25, wherein said housing and said dielectric ionization conduit comprise cylindrical tubes having a generally concentric arrangement, and said outer electrode comprises an annular ring having an inner diameter larger than the outer diameter of said ionization tube and an outer diameter smaller than the inner diameter of said housing tube.

32. The device recited in claim 1, including a diverter connected to the open distal end of the housing that changes the flow direction of the plasma plume.

33. The device recited in claim 32, wherein said diverter divides the plume into more than one flow direction.

* * * * *